US006340213B1

(12) United States Patent
Calobrisi, Jr.

(10) Patent No.: US 6,340,213 B1
(45) Date of Patent: Jan. 22, 2002

(54) COLLAPSIBLE ASTRONOMY STATION

(76) Inventor: Lewis R. Calobrisi, Jr., 192 Audwin Dr., Islip Terrace, NY (US) 11752

( * ) Notice: Subject to any disclaimer, the term of this patent is extended or adjusted under 35 U.S.C. 154(b) by 0 days.

(21) Appl. No.: 09/558,720

(22) Filed: Apr. 24, 2000

(51) Int. Cl.[7] ..... A47B 96/18
(52) U.S. Cl. ..... 312/244; 312/236; 108/25
(58) Field of Search ..... 312/244, 236, 312/209; 108/6, 23, 25, 50.02, 144.11, 147.19, 147.2, 50.13

(56) References Cited

U.S. PATENT DOCUMENTS 3,082,050 A * 3/1963 Baxter et al. ..... 312/244 X
3,132,439 A * 5/1964 McGill ..... 312/244 X
3,156,510 A * 11/1964 Hindin et al. ..... 108/23 X
3,166,028 A * 1/1965 Zagel ..... 108/26 X
3,476,456 A * 11/1969 Canavan ..... 312/244 X
4,076,348 A * 2/1978 Allison ..... 312/244 X

* cited by examiner

*Primary Examiner*—Anthony D. Barfield
*Assistant Examiner*—Michael J. Fisher
(74) *Attorney, Agent, or Firm*—Bauer & Schaffer

(57) ABSTRACT

A fully collapsible and portable astronomy work station comprising a foldable base and a foldable table assembly wherein the table assembly is attached to the folded base section when desired to be transported or attached to the unfolded base section when desired in the fully operational configuration. When in the operational configuration a tray table may be lowered from the table assembly providing an astronomer with a heated back section for his maps and the like as well as a heated telescope eye piece retaining area thus preventing the back section as well as the eye pieces from becoming moist from condensation or dew.

17 Claims, 5 Drawing Sheets

10

88
80
84
44
18
78
42
38
44
68
54
70
40
88
16
38
32
60
38
36
34
26
12
32
52
28
22
50
30
52
24

COLLAPSIBLE ASTRONOMY STATION

BACKGROUND OF THE INVENTION

The present invention relates to a portable work station and in particular to a collapsible and portable astronomy field table.

In order for an urban astronomer to best view celestial bodies, it is usually necessary for them to travel away from the city into the country side where the skies are far less influenced and effected by surrounding urban lights. As a result, it is important for an astronomer to have an astronomy work station which is both collapsible and easily portable so that he can take it with him to many of these rural locations.

In order to satisfy and accommodate the needs of astronomers for a highly portable and fully functional astronomy station many attempts have been made in constructing such a work station which look to incorporate all of an astronomers needs into one unit. In general, such aggregations have resulted hap-hazard arrangements at best and do not take into account many of the needs of the individual astronomer, most important of which are the needs for a collapsible and portable work station.

Therefore, it is an object of the present invention to provide an astronomy work station which overcomes all of the problems noted above.

It is another object of the present invention to provide an astronomy work station which is easily collapsible and portable.

It is a further object of the present invention to provide an astronomy station which can be readily stored.

It is yet another object of the present invention to provide an astronomy station which gives the individual astronomer freedom of mobility to go where he pleases.

It is another object of the present invention to provide an astronomy station which offers the individual astronomer all of the necessities associated with outdoor use.

The foregoing objects, together with other objects and advantages, will be apparent from the following disclosure of the present invention.

SUMMARY OF THE INVENTION

According to the present invention, a fully collapsible and portable astronomy field table is provided. The field table comprises a foldable base and a foldable back assembly. The work station is thus capable of being reduced in size and otherwise operable to erect an accessible table presenting all of the necessary astronomical instruments required. The field table is foldable to allow the user to easily transport it. It is provided with heating elements throughout the back of the table assembly to help evaporate and prevent the formation of dew and condensation on the table section.

Full details of the present invention are set forth in the following description of the invention.

BRIEF DESCRIPTION OF THE DRAWINGS

The invention will be best understood by reference to the following drawings, wherein.

DETAILED DESCRIPTION OF THE PREFERRED EMBODIMENT

Figure 1:
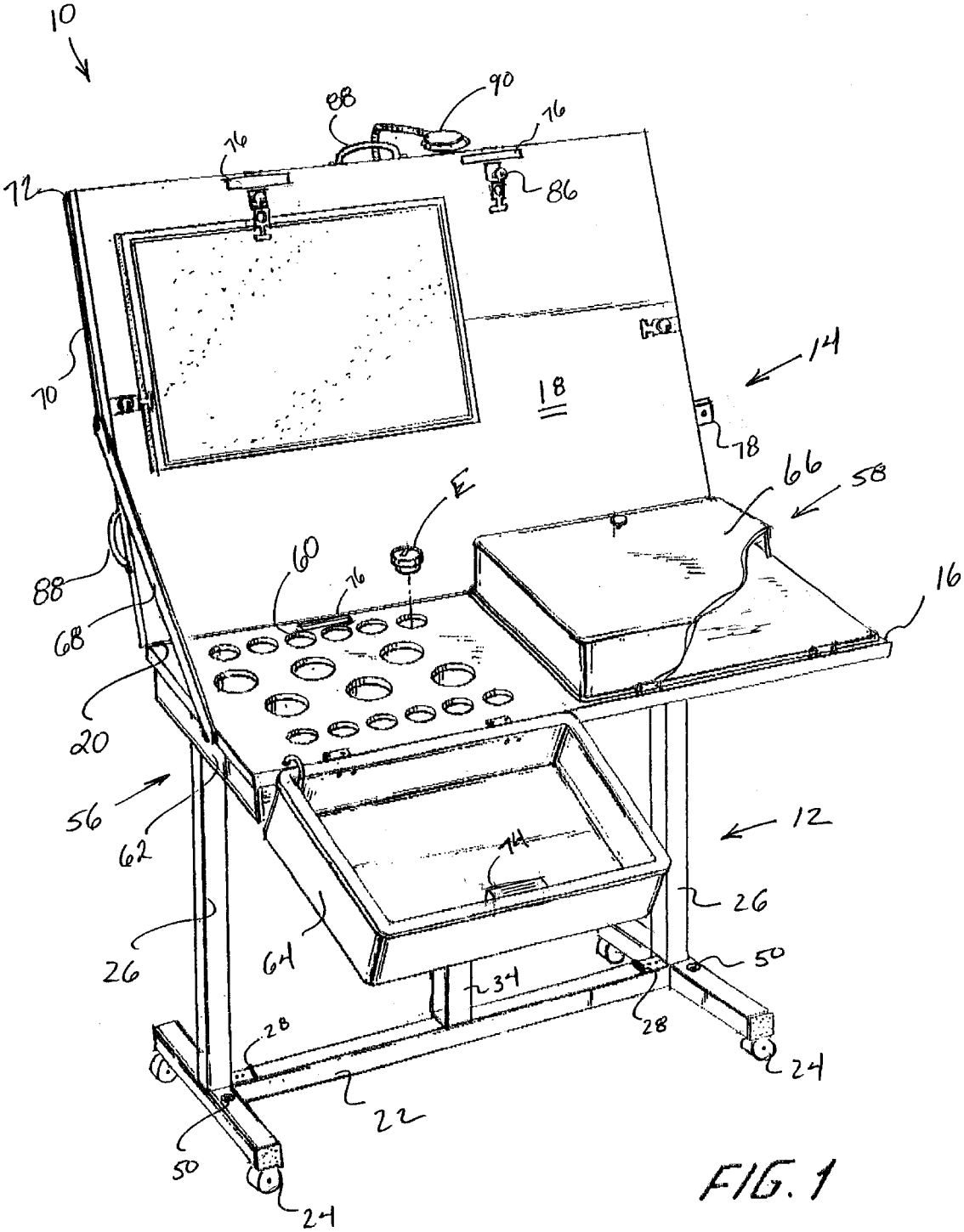
FIG. 1 is a front perspective of the field table fully unfolded and in its operative configuration.

As seen in FIG. 1, the astronomy field table, generally depicted by the numeral 10, comprises a collapsible support stand 12, a table assembly 14 comprising a fold down tray section 16 and a back wall section 18 hinged, as by a piano hinge 20, thereto.

Figures 3, 4:
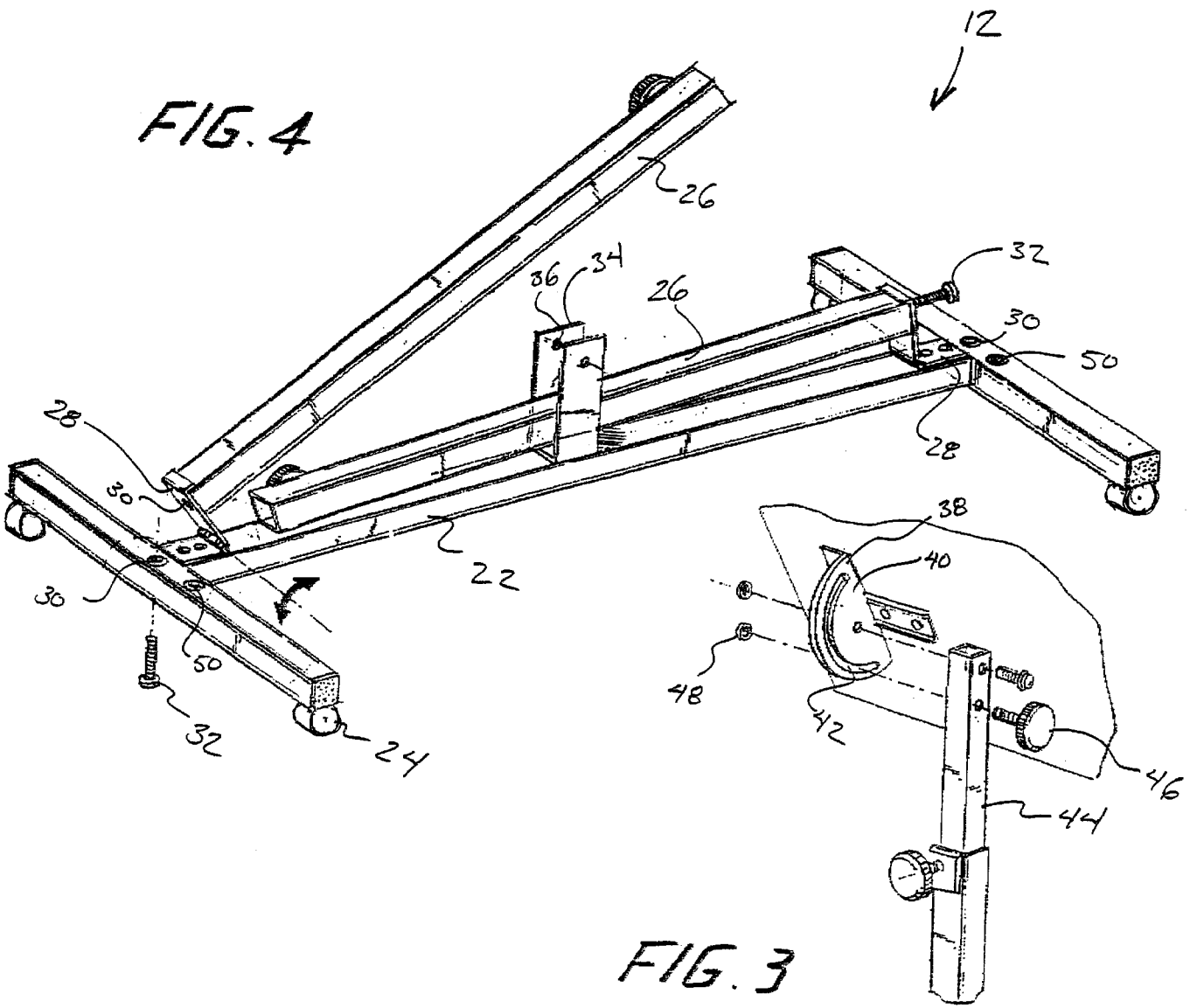
FIG. 3 is a perspective view of the pivot bracket contained in area 3 of FIG. 2.
FIG. 4 is a perspective of the stand partially in open condition.

The support stand 12 comprises an H-shaped base 22 supported on pivoting rollers or casters 24. Extending vertically at either end of the base 22 are a pair of pivotally mounted hollow posts 26. As seen in FIG. 4, the lower ends of each of the posts 26 are attached to one part of a leaf hinge 28, the other part of the hinge 28 being attached to the center bar of the base 22 where the bar joins its cross members.

Aligned with the center bar is a hole 30 fashioned through the cross member passing through the each part of the hinge 28 into the end of the post 26. A bolt 32 is threaded through the members to maintain the post 26 in vertical position. The lower end of the post 26 may be filled with a block or nut member to hold the bolt 32. As seen from FIG. 4 the posts 26 are collapsible one over the other above the center bar. Midway along the center bar is a U-shaped bracket 24, welded or otherwise fixed thereto, so as to receive the overlapping posts 26. The arms of the bracket 34 are sufficiently high so as to extend above the overlapping posts 26 and are provided with holes 36 at its upper end.

Figure 2:
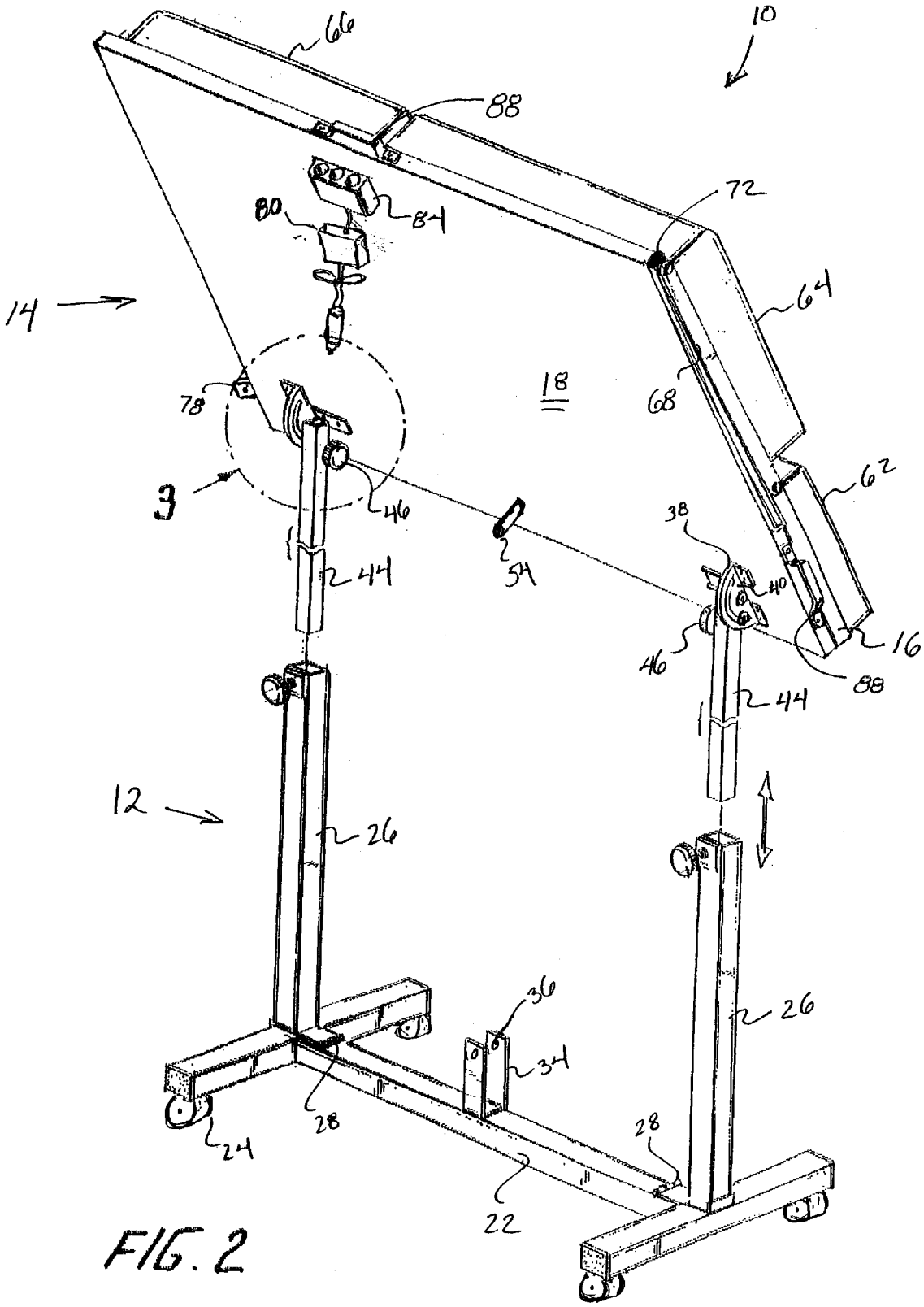
FIG. 2 is a rear perspective view of the field table partially disassembled.

Turning to FIG. 2, it will be seen that the posts 26 themselves are provided with a telescoping member 38 allowing for adjustment in the height of the table 14 itself. The extensions 38 are held in fixed adjusted position by a thumb screw knob 40.

The table 14 is tiltably mounted on to the posts 26. This is effected, as seen in FIGS. 2 and 3. Fixedly mounted to the rear surface of the back section 18 is a pair of trunnion like brackets 38. The brackets 38 have a cam plate 40 extending perpendicularly to the surface of the back section 18 and are provided with a semicircular slot 42. Pivotally held by the trunnion like brackets 38 are legs 44. Each leg 44 is insertable in a respective one of the posts 26.

The posts 26 have at their upper ends a lock screw 46 which is manipulatable to lock the legs 44 in a selected elevated position. The upper end of the legs 44 are provided with a lock screw 46 which passes through the circular slot 42. The lock screw 46 is provided with a nut 48 engaging the cam plate 40 so that the back section 18 can be tilted within the range of the slot 42 and be held in fixed position by tightening the lock screw 46. Preferably, the arrangement is such that the slot 42 permits the user to vary the tilt of the table assembly 14 anywhere from a fully vertical position to a fully horizontal position and any desired angle in between.

Figure 6:
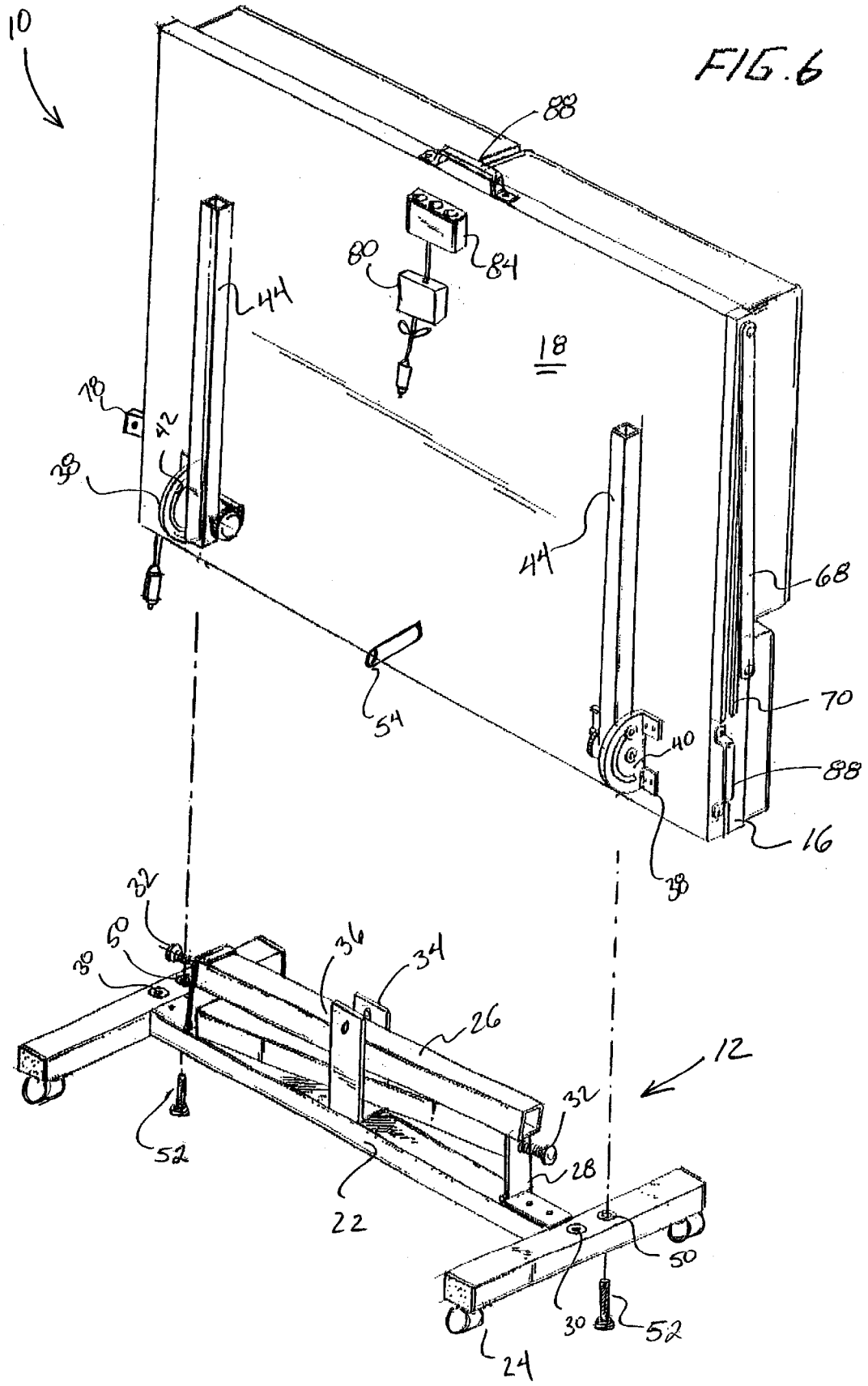
FIG. 6 is a rear view of the field table in the fully collapsed storage and transportation configuration and disassembled from the stand.

As will be seen from FIG. 6, disassembly and storage of the work station 10 is conveniently effected by removing the legs 44 from the posts 26 and collapsing them toward the back wall where they are then locked into place. The posts 26 are collapsed and held one atop the other in the U-shaped bracket 34. The entire table assembly 14 is then placed upright on the H-shaped base 22 which is provided with a second pair of holes 50 into which screws 52 pass and engage corresponding holes along the bottom edge of the wall section 18. The screws 52 are secured in the lower edge of the back wall section 18 in permanent manner. A peg 54 extends from the lower rear portion of the back wall section 18 for engagement with holes 36 of bracket 34 thus securing the posts 26 when collapsed. With the table itself in collapsed condition the entire work station 10 is now portable and easily stored or transported by either carrying or by rolling on pivot rollers 24.

Figure 5:
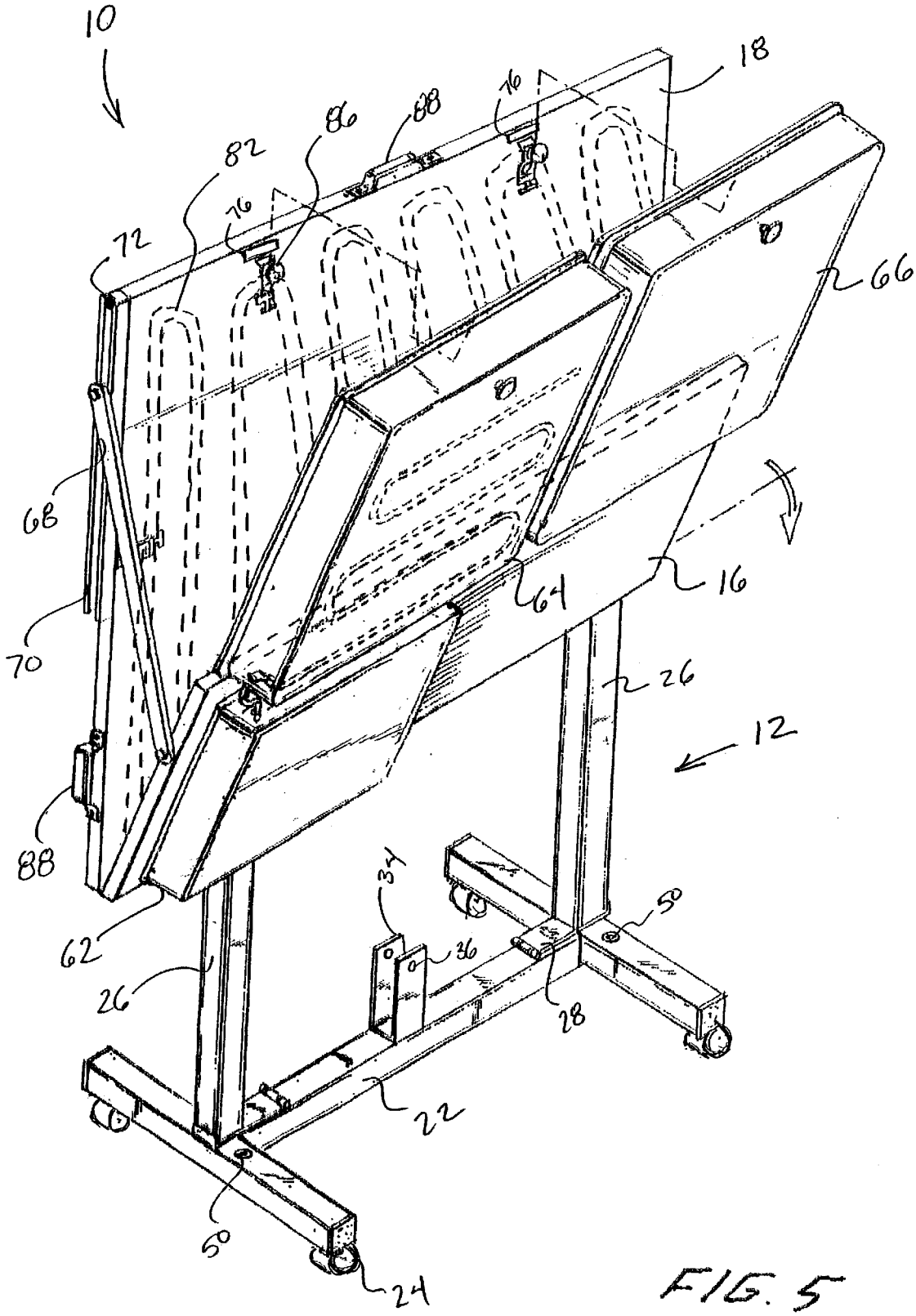
FIG. 5 is a front perspective of the field table partially closed.

Turning now to FIGS. 1 and 5, the construction of the table assembly 14 will be shown. The tray section 16 comprises a heated telescope eye piece retaining section 56 and a power supply retaining section 58. The eye piece retaining section 56 of the tray section 16 comprises a plurality of retaining holes 60 passing completely therethrough. The retaining holes 60 are adapted to retain and hold standard varying sized telescope eye pieces E. Alternatively, the retaining holes can be adapted to receive any ancillary item associated with the work to be performed by the user. The eye piece retaining section 56 is provided with a fixedly mounted bottom cover 62 beneath the eye piece section 56 itself and a pivotally mounted heated lid 64 above the eye piece section 56. A pivotally mounted lid 66 is provided over the remaining work surface portion of the tray assembly 16.

The covers 64 and 66 are provided with magnets 74 along their front edge for contact with strike plates 76 along the rear edge of the tray assembly 16. The contact of the magnet 74 with the strike plates 76 ensure that the covers remain closed.

In use, eye pieces E are held in the heated receptacle section 56 until needed at which time the user lifts the top cover 64, removes the desired eye piece E and recloses the top cover 64, thereby maintaining the fully enclosed heated environment. As a result, the eye piece E, which the user has chosen, is free from moisture and condensation and ready to use.

The power supply retaining section 58 comprises a pivotally mounted cover 66 which encloses a power supply (110 AC 12 V DC 2.5 AMP desk top power supply). (not shown for clarity).

The tray assembly 16 is supported by an arm 68 pivotally attached at its lower end to the side edge of the tray section 16. The upper end of the arm 68 slidably engages rail 70 which is mounted to the side edge of the back section 18.

A stop 72 is fixed to the lower end of the rail 70 to prevent the upper end of the arm 68 from sliding out of the rail 70. In use, when the tray section 16 is lowered, the arm 68 slides down the rail 70 and comes to rest when it comes into contact with stop 72 thus maintaining the tray 16 in a substantially horizontal plane.

In order to collapse the tray 16 and the back section 18, the heated top cover 64 and the power supply cover 66 are first completely opened. The tray section 16 is then raised until its top surface comes into contact with the front surface of the back section 18. The magnets of the covers 64 and 66 then contact strike plates 76 located along the top edge of the front surface of the back wall 18. Latch means 78 are mounted to the side edge of the tray section 16 as well as the side edge of the back section 18 which align with one another when the tray section 16 comes into contact with the back section 18. The latch means 78 ensure that the tray section 16 remains closed against the back section 18 when the work station 10 is in its collapsed storage and transport configuration.

As seen in FIG. 5, a heating element 82 is interposed within the back section 18. The inner front surface of the back section 18 is uninsulated while the inner rear surface of the back section 18 is insulated, thereby ensuring that the majority of the radial heat produced by the heating element 82 is solely conducted through the front surface. The heating element 82 provides sufficient heat (108 to 131 F. degrees) to warm the front surface and prevent any dew or condensation from forming on the surface while in use outdoors. Additionally, any charts or maps attached to the front surface will be kept sufficiently dry to permit the user to write on them easily.

For example, many astronomers use grease pencils to write on laminated star maps and therefore will not be able to write on these maps if they are wet or moist. The heating element plugs into any standard 12 volt DC power supply (not shown). The power supply is preferably one that provides a minimum of 12–17 AMP hours for uninterrupted use. While a portable 12 volt DC power supply is recommended, any other typical power source for heating the heating element 82 may be used, such as an electrical outlet, batteries or portable electrical generator.

A heater control box 80 is mounted to the rear surface of the back section 18 for control of the amount of heat produced by the heating element 82. An electrical adapter 84 is mounted near the upper edge of the rear surface of the back section 18. While a standard 12 volt DC cigarette lighter adapter is used any other form of portable outlet can be mounted.

The holding clips 86 are mounted along the periphery of the front surface of the back section 18. The clips 86 hold astronomy charts, tables, maps or the like to the front surface of the back section 18.

A plurality of handles 88 are mounted along the outer edge of the back section 18 to aid in carrying and transportation of the work station 10.

A light 90 is provided which plugs into the electrical adapter 84 and is used to illuminate the front surface of the back section 18 with a reddish light so as not to dilate the users pupils when turned on at night.

Various modifications and changes of the present invention have been disclosed herein and others will be apparent to those skilled in this art. Therefore, it is to be understood that the present disclosure is by way of illustration and not limiting to the present invention.

What is claimed:

1. A portable field table for temporary work activity comprising:

a height adjustable base, a case having a tray and a complimentary sized back pivotally attached along an edge of said tray, means for limiting the relative pivoting of said tray and said back between a first position wherein said back covers said tray and a second position wherein said back is open at a selected angle to said tray, said tray having in part a flat work surface and in port a surface having means for receiving devices ancillary to the work to be performed and tools, said receiving means including in part a plurality of varying sized holes formed through the surface of said tray for retaining ocular devices and heating means within said tray for maintaining said ocular device warm when in use, and means for mounting said case on said height adjustable supporting base for maintaining said table in a selected horizontal position for use.

2. The table according to claim 1, wherein when said tray and back are in the first position said supporting base and case are removable from each other whereby said case is portable.

3. The table according to claim 2, wherein said base is collapsible and said case and base are provided with cooperating means wherein said collapsed base is secured to the exterior of said case and carriable jointly therewith.

4. The table according to claim 3, wherein said base comprises of posts each of said posts having a member pivotally attached to the bottom of said table and a second member telescopically receiving said first member, each of said second members being pivotally attached to a common horizontally disposed connecting member and means for fixing said first and second member at selected positions.

5. The table according to claim 1, wherein said receiving means including in part a plurality of varying sized holes formed through the surface of said tray for retaining ocular devices and means within said tray for maintaining said ocular device warm when in use.

6. The table according to claim 1, wherein said tray further comprises a pair of pivotally attached lids along an edge of said tray opposite to said back, each of said lids pivot between a first position wherein said lids cover said flat work surface in part and said ocular receiving means in part and a second position wherein said lids open sufficiently to permit said back to cover said tray when in their respective first position.

7. The table according to claim 6, wherein said lid covering said ocular receiving means further comprises heating means wherein when in use said heating means warms said ocular devices.

8. The table according to claim 7, wherein heater control box is provided for controlling the amount of heat produced by said heating means.

9. The table according to claim 8, further comprising illumination means mounted to said back section.

10. The table according to claim 6, wherein said tray further comprises a bottom cover fixedly attached below said receiving part of said tray whereby said tray is provided with enclosure for said means retaining said ocular devices.

11. The table according to claim 1, wherein said back is provided with adjustable heating means for warming the front. surface of said back section.

12. The table according to claim 11, wherein said heating means further comprises a heating element interposed within said back section.

13. The table according to claim 1, further comprising a portable power supply.

14. The table according to claim 13, further comprising an electrical adapter mounted to said back section.

15. The table according to claim 14, wherein a plurality of holding clips are mounted to said back section for holding and retaining papers, maps or the like.

16. The table according to claim 1, further comprising securing means along a side edge of said tray for cooperation with corresponding securing means along a side edge of said back whereby said tray and said back are held together when in said first position.

17. The table according to claim 1, further comprising casters mounted to said base.

* * * * *